US005826606A

United States Patent [19]

Davenport

[11] Patent Number: 5,826,606

[45] Date of Patent: Oct. 27, 1998

[54] CANE TIP

[76] Inventor: Ronald K. Davenport, 5511 Verano Pl., Irvine, Calif. 92612

[21] Appl. No.: 939,318

[22] Filed: Sep. 29, 1997

Related U.S. Application Data

[60] Provisional application No. 60/027,802, Oct. 3, 1996.

[51] Int. Cl.[6] ..... A45B 9/04

[52] U.S. Cl. ..... 135/82; 135/86

[58] Field of Search ..... 135/77, 82, 83, 135/84, 86, 68

[56] References Cited

U.S. PATENT DOCUMENTS

| | | | |
|---|---|---|---|
| 960,700 | 6/1910 | Pratt | 135/84 |
| 2,888,022 | 5/1959 | Fanning | 135/82 |
| 3,251,372 | 5/1966 | Smith | 135/86 |
| 4,135,536 | 1/1979 | Willis | 135/84 |
| 4,630,626 | 12/1986 | Urban | 135/84 |
| 4,899,771 | 2/1990 | Wilkinson | 135/86 X |
| 5,178,176 | 1/1993 | Fetterman | 135/86 |
| 5,465,745 | 11/1995 | Davis | 135/82 |

FOREIGN PATENT DOCUMENTS

| | | | |
|---|---|---|---|
| 540217 | 8/1955 | Belgium | 135/84 |
| 3004028 | 8/1981 | Germany | 135/84 |
| 161290 | 4/1921 | United Kingdom | 135/83 |

*Primary Examiner*—Lanna Mai
*Attorney, Agent, or Firm*—Thomas P. Mahoney

[57] ABSTRACT

A cane tip having a body incorporating a resilient, shock-absorbing member which has radial projections extending to the surface of the cane tip.

2 Claims, 2 Drawing Sheets

CANE TIP

This application claims the benefit of U.S. Provisional application No. 60/027,802 filed Oct. 3, 1996.

This invention relates to a resilient tip which may be utilized in conjunction with canes, walkers, crutches, or the like. Such tips are commonly utilized in conjunction with devices supporting individuals who encounter mobility difficulties and who need ancillary support.

BACKGROUND OF THE INVENTION

The conventional tip is commonly formed of rubber or polymeric materials which are subject to flow and deformation and which are designed to obtain a maximum frictional grip on a supporting surface and to absorb, in part, the shock loads which are imposed upon the hands or arms of an individual utilizing a supporting means having a tip or tips thereupon.

The conventional tip has a centrally located bore adapted to receive the lower extremity of a cane, or the like, and has its extreme end engagable with the adjacent supporting surface. However, for some inexplicable reason, such conventional tips are commonly formed with a rounded extremity which, under certain conditions, such as slippery or wet surfaces, is not particularly adequate and frequently tends to slip or slide, causing the individual depending thereupon to fall with, sometimes, serious consequences.

In addition, conventional tips are fabricated from rubber or polymeric materials and provide a certain shock-absorbing function which mitigates the shock load imposed upon the user of the cane or other implement incorporating the tip. However, such shock-absorbing function of conventional tips is relatively limited.

OBJECTS AND ADVANTAGES OF THE INVENTION

It is an important object of the present invention to provide a tread that allows for the dispersal of liquids that the cane tip may come into contact with on surfaces, as well as those liquids temporarily adherent within the geography of the tread design itself, thereby providing superior traction and safety for the consumer. This property of the tread helps maintain sufficient friction between the cane tip and the ground surface through dispersal of any liquids collected within the tread which could create the potential for a hydroplaning effect. An important physical property of liquids is that they cannot be compressed and, when constricted under pressure, liquids act as a lubricant eliminating the rolling friction necessary for adherence between the cane tip and the ground surface. The dispersal property of the invention greatly enhances the stability of the cane tip, thereby effectively preventing injury to the consumer.

It is another object of the present invention to provide a shock-absorbing means in the form of a gel-filled or air-filled PVC capsule incorporated as an integral part of the cane tip structure located between the receiving bore end of the cane tip and the lower tread area of the cane tip base. Columns or straps formed in the tip body are distributed equidistantly around the capsule, effectively connecting the cane tip base, the capsule section, and the receiving portion of the cane tip. The capsule, constructed of PVC or other material, incorporates a gel-like elastic polymer or a pocket of air which dampens the effects of the kinetic energy inherent with each impact of the cane tip on the ground.

It is another object of the present invention to provide a cane tip having no external ridges, shoulder areas, skirts, or plateaus. The upper extremity of the cane tip creates a completely flush intersection between the cane and cane tip, thereby reducing the potential of the cane surface from becoming caught within or against obstacles such as furniture legs and the like.

It is another object of the present invention to have a slightly curved or rounded outer edge of the base adjacent to the tread area of the cane tip. This slightly rounded edge, in conjunction with the tread and the shock-absorbing means, presents a greater tread area of the cane tip to the ground surface.

It is another object of the present invention to provide retaining flexible ribs within the receiving bore for the cane which, when the cane is inserted, bend downwardly providing a more secure coupling or fit between the cane and the cane tip. The downward angle of the ribs provides an environment with sufficient surface friction to maintain a secure interface between the two separate components. At the base of the receiving bore, there is a disk made of polyester, nylon, or metal which provides a foundation for the base of the cane to rest upon.

It is another object of the present invention that the tip, when utilized as the rubber foot of a shower chair, such as those used by the geriatric and disabled, allows for the drainage of water from within its tread, thereby reducing the potential for the growth of fungi. Thus, it may also contribute to a more hygienic environment. The tip may also be used with other consumer goods, such as commodes, where the collection of liquids within a standard rubber tip base might cause the production of bacterial growth.

DESCRIPTION OF THE PREFERRED EMBODIMENTS

Figure 1:
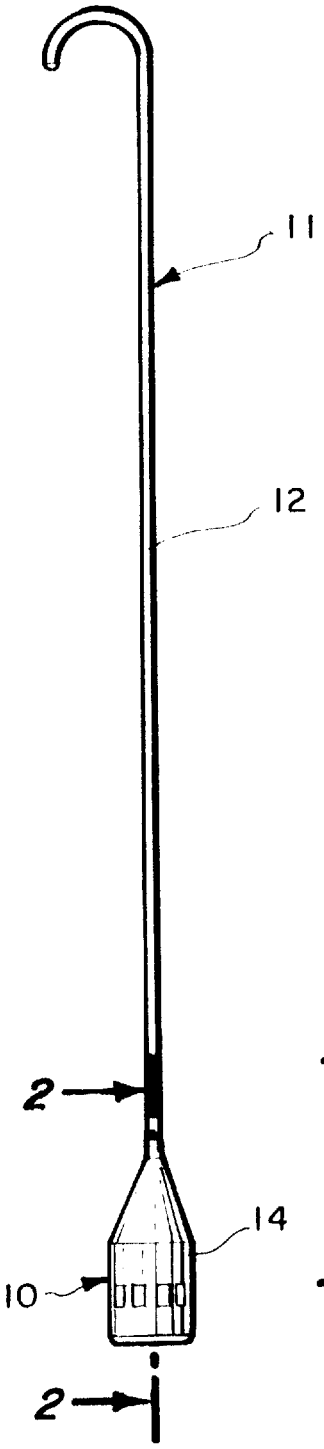
FIG. 1 is a side elevational view showing the cane/crutch/multipurpose tip of the present invention.
Figure 2:
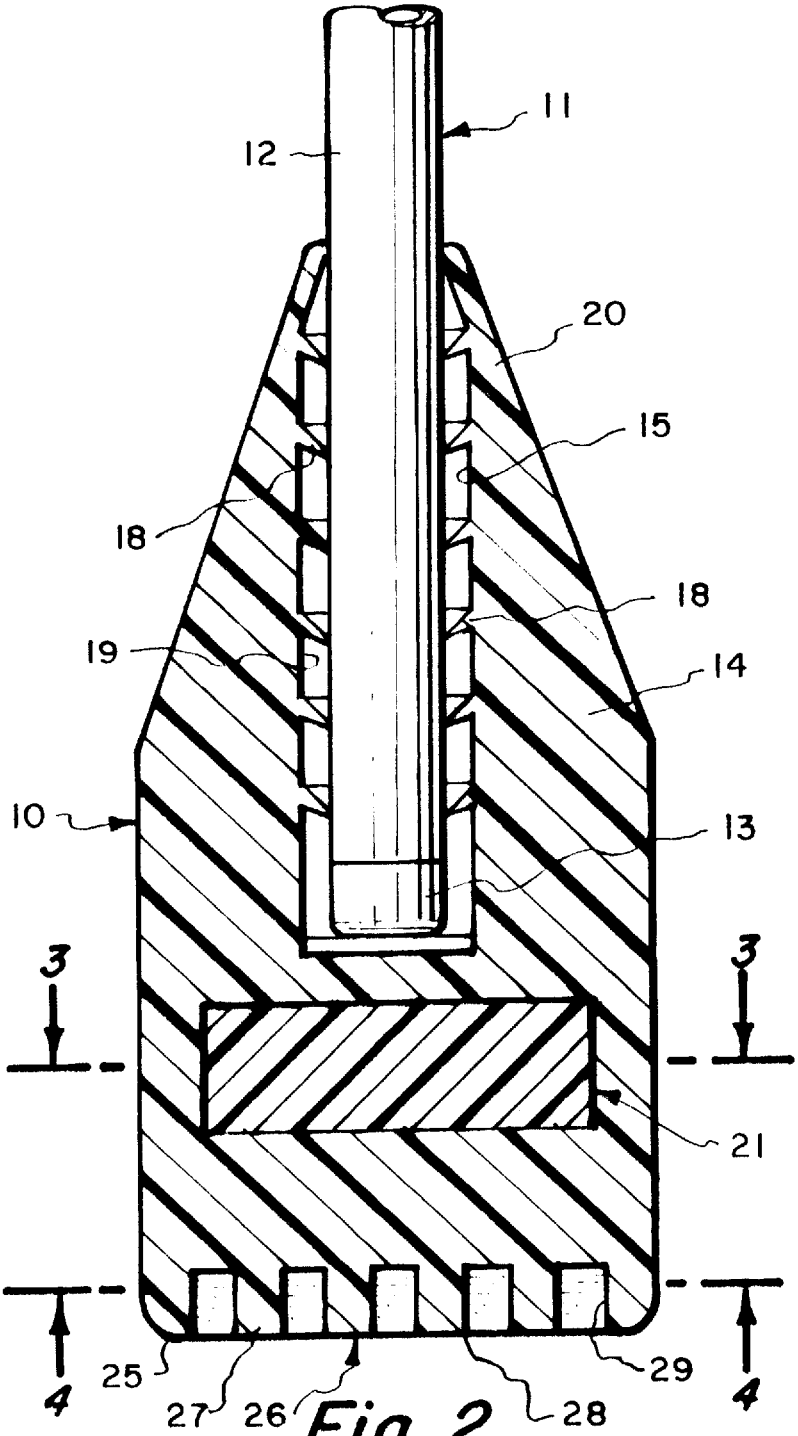
FIG. 2 is a vertical section taken on line 2—2 of FIG. 1.

Referring now to the drawing, and more specifically to FIG. 1 thereof, a cane tip 10 is shown on the lower end of a cane 11. The cane may be of any desired construction, such as a metal tube on shaft 12 having its lower end closed by a plug 13. The relative sizes of the tip 10 and cane 11 are for the purpose of showing the details of the tip and, of course, the tip 10 can be of any size.

In addition, although the tip is described as utilized in conjunction with a cane, it can be used with a wide variety of auxiliary supports such as ambulatory walkers, shower chairs and commodes, multi-footed walking devices or canes, or any legged object utilized where support on webbed surfaces is desired.

Of course, the tip can be utilized effectively on dry surfaces where the self-adjustment features of the tip, to be adverted to in greater detail hereinbelow.

The cane tip 10 has a generally cylindrical body 14 formed of elastic polymer, latex or rubber-like material, and a general cylindrical bore 15, which has its internal surface provided with securement means such as annular ribs 18, alternating with internal annular indentations 19 within the wall of the bore which allow the ribs 18 to be compressed and slightly displaced in a downward direction upon the insertion of the cane shaft 11. This assures firm frictional engagement of the bore 15 with the cane 11, while enabling the cane to be removed, when desired.

The exterior of the body is smooth, having no external protuberances, and tapers upwardly, as at 20, to achieve a smooth, streamlined exterior surface. The streamlined design reduces the possibility of the cane tip becoming entangled in objects such as the legs of furniture.

Shock-absorbing means is incorporated in the cane tip body 14 in the form of a capsule 21 fabricated from PVC or other synthetic plastic or the equivalent and filled with air. The capsule 21 differs in its shock-absorbing characteristics from the body 14 of the crutch tip 10 in that it deflects and absorbs shock loads more effectively than the remainder of the body 14. This permits the tread to self-adjust to surface irregularities.

Figure 3:
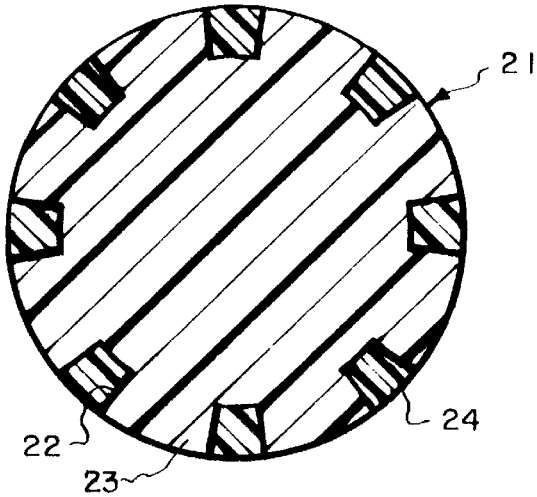
FIG. 3 is a transverse sectional view taken on line 3—3 of FIG. 2.

The capsule 21, as best shown in FIG. 3 of the drawings, is of generally cylindrical configuration but incorporates a plurality of perimetrical openings 22 which define radial arcuate segments 23 protruding between columns or straps 24 formed integrally with the body 14 of the crutch tip 10. A resilient or elastic disk of the same size and configuration can be substituted for the capsule 21. The columns or straps 24 serve as additional structural support for the capsule 21 and as structural connections between the lower and upper portion of the body 14.

Occupying the outer perimeter of the base of the cane tip body 14 is a slightly curved edge or periphery 25 which constitutes the outermost portion of the base of the cane tip 10. This structural design, when incorporated with the other components of the cane tip 10, contributes to a more pliable and adherent footing for contact with ground surfaces.

Figure 4:
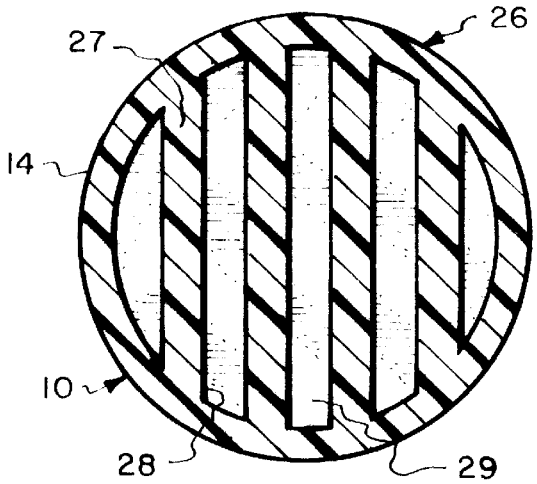
FIG. 4 is a transverse sectional view taken on line 4—4 of FIG. 2.

The lower surface of the cane tip 10 is a frictional ground engaging pad or tread 26, which may be generally cylindrical, and is an integral part of the body 14. The lower surface of the tread 26 has a plurality of depending ribs 27 arranged in adjacent, spaced relation with respect to each other in parallel, as best seen in FIG. 4.

The depending ribs 27 are of a generally oblong rectangular configuration and are arranged parallel with the outer edges having a slightly crescent shape conforming to the shape of the body 14 of the cane tip 10. The spaces between the edges 28 of the ribs are shown as grooves or slots 29 extending inwardly from the lower or outer end surface 25 of the tread 26. These grooves 29 are unobstructed at either end and, thus, allow for the dispersal of liquids which may either temporarily collect within the grooves 29 of the tread, or for any liquids which are present on ground surfaces. Additionally, the several depending ribs 27 have the flexibility inherent in the rubber-like latex material used in the construction of the general structure of the cane tip 10.

Figure 6:
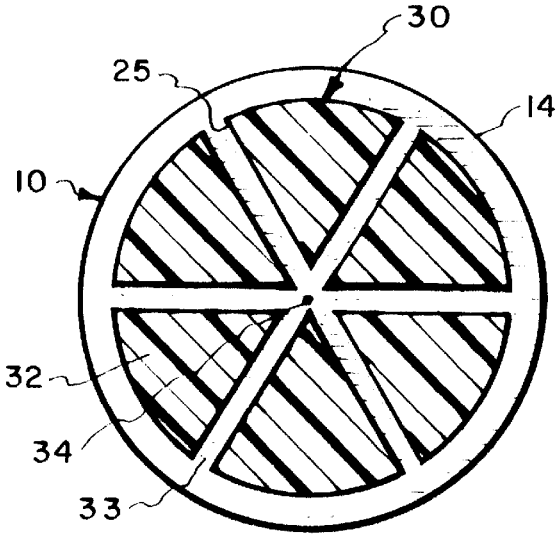
FIG. 6 is a sectional view of an alternative tread configuration.

An alternative embodiment 30 of the tread is shown at FIG. 6 as consisting of a plurality of pie-shaped tread segments 32 arranged in adjacent, spaced relationship with respect to each other and in a star-shaped array, as best seen in FIG. 6 of the drawings.

The spaces between the tread segments 32 define radial grooves or slots 33 extending inwardly from the curvilinear edge 25 of the tread area and terminating in a common central area 34. The grooves are unobstructed at either end and, thus, allow for the dispersal of liquids in the same manner as the previously discussed tread of FIG. 4.

Because of the provision of the shock-absorbing means provided by the capsule 21, the treads 26 and 30 can be displaced to more effectively adjust to irregularities and other anomalies of the ground surface. The shock-absorbing characteristics of the capsule 21 cause the surfaces of the treads 26 and 32 to more effectively engage the adjacent ground surfaces.

Typical use is shown in FIG. 4, wherein the cane tip is depicted in the process of dispersing liquid from within the tread 26 as it comes into contact with liquid on the ground surface. Similar dispersal is accomplished by the star-shaped tread 30 of FIG. 6. It will be apparent that the end surface of the tread remains in firm, frictional engagement with the ground surface. Also, the angle of impact is depicted indicating the increased initial surface area the cane tip provides.

From the foregoing, it is seen that the present invention provides a cane tip which is simple in construction for economy of manufacture, while affording unique functional advantages and being durable and entirely reliable throughout a long, useful life.

Although the present invention has been described in some detail by way of illustrations and example for the purpose of clarity of understanding, it is understood that certain changes and modifications may be made without departing from the scope of the claims.

I claim:

1. A cane tip for installation on the lower end of a cane shaft having a body with a bore for receiving the lower end of said cane tip, said body incorporating a receptacle adjacent the lower extremity thereof, said receptacle having a plurality of radial openings communicating with the exterior of said body; and a shock-absorbing capsule located in said receptacle and having a plurality of radial arcuate segments protruding through said openings.

2. A cane tip according to claim 1 wherein said body and said capsule have different shock-absorbing characteristics and the radial arcuate segments of said capsule protruding through said openings extend the shock-absorbing function of said capsule to the surface of said body.

* * * * *

UNITED STATES PATENT AND TRADEMARK OFFICE

CERTIFICATE OF CORRECTION

Figure 5:
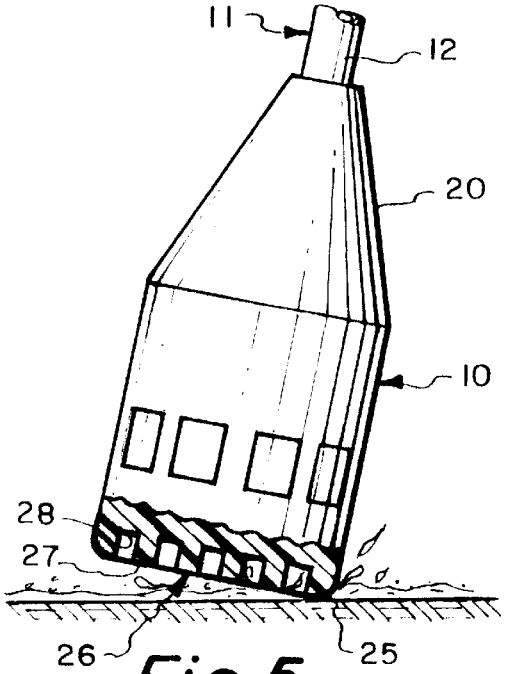
FIG. 5 is a partial second view of the cane tip's initial ground engagement.

PATENT NO : 5,826,606
DATED : October 27, 1998
INVENTOR(S) : Ronald K. Davenport It is certified that error appears in the above-identified patent and that said Letters Patent is hereby corrected as shown below:

In column 4, line 22, "FIG. 4," should be changed to--FIG. 5,--.

Signed and Sealed this

First Day of June, 1999

*Attest:*

Q. TODD DICKINSON

*Attesting Officer*

*Acting Commissioner of Patents and Trademarks*